United States Patent [19]

Stull

[11] Patent Number: 5,044,530

[45] Date of Patent: Sep. 3, 1991

[54] RIBBON-TYPE DISPENSING CAP HAVING AN AXIAL CLOSURE BLADE THAT ROTATES ALONG WITH AN OUTER APERATURED CAP BUT REMAINS LONGITUDINALLY STATIONARY

[76] Inventor: Gene Stull, 1086 Hacklebarney Rd., Chester Township, Morris County, N.J. 07930

[21] Appl. No.: 477,555

[22] Filed: Feb. 9, 1990

[51] Int. Cl.[5] ..... B67D 47/00

[52] U.S. Cl. ..... 222/521; 222/549

[58] Field of Search ..... 222/519–522, 222/524, 548, 549, 552, 48, 505, 507, 559, 562, 563; 215/311, 313; 220/255

[56] References Cited

U.S. PATENT DOCUMENTS

| | | | |
|---|---|---|---|
| 1,895,854 | 1/1933 | Lipschitz | 222/507 |
| 3,108,721 | 10/1963 | Nebinger | 222/519 X |
| 3,216,630 | 11/1965 | Stull | 222/499 |
| 3,285,479 | 11/1966 | Porter et al. | 222/521 |
| 3,369,707 | 2/1968 | Porter et al. | 222/83 |
| 3,549,060 | 12/1970 | Smylie | 222/513 |
| 3,578,223 | 5/1971 | Armour | 222/521 |
| 3,901,410 | 8/1975 | Schultz | 222/521 X |
| 4,358,031 | 11/1982 | Lohrman | 222/521 X |
| 4,754,899 | 7/1988 | Stull | 222/521 |
| 4,842,169 | 6/1989 | Stull | 222/521 |

FOREIGN PATENT DOCUMENTS

| | | | |
|---|---|---|---|
| 1203668 | 10/1965 | Fed. Rep. of Germany | 222/521 |

*Primary Examiner*—Michael S. Huppert
*Assistant Examiner*—Kenneth DeRosa
*Attorney, Agent, or Firm*—H. Gibner Lehmann; K. Gibner Lehmann

[57] ABSTRACT

A dispensing cap construction for containers, having a cap body for attachment to a container neck, and having a discharge spout portion through which the container contents can be discharged, and a closure cap turnably carried by the cap body. The closure cap has a non-round or slit-shaped orifice, and a stopper blade in the closure cap is received in the orifice so as to close it off. The stopper blade is rotatably mounted on the spout portion of the cap body to enable it to rotate simultaneously with, or in unison with turning movements of the closure cap. The cross section of the stopper blade is such that it can fit sealingly in the orifice. The cross section of the blade is, in the disclosed embodiment, substantially of rectangular or oblong configuration. In addition, there are cooperable elements on the cap body and closure cap, for effecting relative axial movement of the stopper blade and the closure cap in response to turning of the closure cap on the cap body, thereby to enable the stopper blade to close and open the orifice. Where the orifice is slit-shaped it imparts a wide and thin, ribbon-shaped characteristic to the discharged product, and is especially well adapted for dispensing mustard, ketchup, cream dressings or the like where such a ribbon characteristic is desired.

17 Claims, 1 Drawing Sheet

RIBBON-TYPE DISPENSING CAP HAVING AN AXIAL CLOSURE BLADE THAT ROTATES ALONG WITH AN OUTER APERATURED CAP BUT REMAINS LONGITUDINALLY STATIONARY

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates generally to closure cap constructions and more particularly to devices of the type having a cap body with an upstanding sealing peg which is received in the discharge orifice of a turnable twist cap carried on the cap body, to selectively close off the orifice in response to turning of the twist cap.

2. Description of the Related Art Including Information Disclosed Under 37 CFR §§1.97–1.99

U.S. Pat. Nos. 3,216,630; 4,754,899 and 4,842,169 disclose various types of prior sealing-type twist cap constructions, all employing stopper pegs which have a generally cylindrical exterior surface configuration, preferably with rounded or beveled ends. These pegs provide a seal with the cylindrical walls of the discharge opening in the respective twist cap when the latter is placed in its fully seated, sealing position.

U.S. Pat. No. 3,549,060 illustrates a cap construction comprising a twist cap and employing a stopper peg having the configuration of a truncated cone. The surface of the cone seals against the walls of a discharge orifice in the twist cap.

In prior known caps having round discharge openings, where the product being dispensed is relatively viscous as in the case of ketchup or mustard, such product emerges in the shape of an elongate, thin bead. In use, the container is inverted and squeezed while the opening of the twist cap is positioned over or applied to the underlying food (i.e. hot dog, etc.).

Efforts have been made to provide cap structures with elongated openings, in which the product being dispensed would be discharged in the shape of a flat ribbon, as opposed to a bead of essentially round cross section. Such a ribbon shape has been considered desirable for use with mustard and ketchup, since it results in a more uniform application over the surface of the particular food to which it is being applied, be it hamburgers, hot dogs, or other food substances.

However, such attempts to achieve ribbon-type discharge characteristics have met with little commercial success. In particular, U.S. Pat. Nos. 3,285,479 and 3,369,707 both illustrate closure cap constructions having twist caps provided with slit-like openings in their ends, in which are received blade-like sealing members. The blade members are fixedly mounted on the undercap or base cap, and molded so as to have sufficient resiliency to enable their upper ends to deformably twist a limited extent without breaking, and without taking a permanent "set".

In U.S. Pat. No. '707, as the twist cap is unscrewed it rides up cam tracks provided on the base cap. The blade is normally of planar configuration and occupies the slit in the twist cap. During such turning the upper end portion of the blade is forcibly twisted and deformed, and eventually separates from the walls of the slit to provide a discharge passage for the product. Following use, the consumer re-seats the twist cap by turning it in a screwing-on direction, with the blade being restored to its initial planar shape by virtue of its resiliency, and re-establishing its position occupying the slit in the twist cap.

U.S. Pat. No. '479 discloses a similar arrangement, except that the twist cap is not raised by means of a cam track on the base cap. Instead, when the twist cap is turned in either direction, the blade becomes deformed as it is engaged by the inner conical surface of the twist cap, with the latter being cammed upwardly by such engagement, to the extent that the slit rises 1 above the blade and presents a clear opening for product discharge to occur. Re-sealing is accomplished by merely pushing downwardly on the twist cap. As this is done, the blade tends to restore the twist cap to is original circumferential position, and the walls of the slit slide over the upper end of the blade, to re-establish the seal.

A number of specific problems have occurred with dispensers of the type involving deformable stopper blades as described above. In particular, it is difficult to fabricate a sealing member in the form of a flat blade which is sufficiently resilient in order not to take a "set" especially following an extended period of use. In addition, attempts to make a plastic blade relatively stiff often resulted in the blade cracking or breaking during use, as opposed to merely flexing, as was desired. In the event of such breakage, the sealing function of the dispenser was completely lost, and there was the possibility of plastic fragments finding their way into the dispensed product. This was particularly troublesome where the substance being discharged was a food such as mustard, ketchup or other creamy material such as dressings and the like.

Even where breakage of the blade did not occur, smooth operation of the cap was difficult to attain. In particular, the use of the blade as a cam to shift the cap, as in U.S. Pat. No. '479, caused undue stresses on the blade, and it is believed that the design parameters inherent in prior blade type sealing caps do not lend themselves toward adaptation to a smooth and reliable operating mechanism for a dispensing cap.

SUMMARY OF THE INVENTION

The above disadvantages and drawbacks of prior ribbon-type dispensing caps are obviated by the present invention which has for one object the provision of a novel and improved ribbon-type cap construction which is especially smooth in its operation, and both rugged and reliable over extended periods of use.

A related object of the invention is to provide an improved cap construction as above set forth, which is simple in its structure, and capable of being molded in simple mold cavities, and which lends itself to assembly by means of automatic capping equipment.

Still another object of the invention is to provide an improved cap construction as above characterized, which is resistant to inadvertent binding or jamming, or stress-related breakage of the cap components, and is thus capable of long, trouble-free operation.

Yet another object of the invention is to provide an improved cap construction in accordance with the foregoing, which has an aesthetically pleasing appearance and thus has consumer appeal.

Still another object of the invention is to provide an improved cap construction of the kind indicated, wherein residual product that may accumulate around the dispensing orifice can be readily wiped clean with a towel or napkin.

A still further object of the invention is to provide a cap construction as outlined above, wherein the possibility of inadvertent contamination of the contents is virtually eliminated by virtue of sealing structures, which maintain their integrity over time, making the cap construction especially well adapted for use with foods generally, and particularly in restaurants or fast-food chains where different and non-related customers handle or use the dispenser at different times throughout the day.

The above objects are accomplished by a dispensing cap construction for containers, comprising a cap body having means for attaching it to a container neck and a discharge spout portion through which the container contents can be discharged, and a closure cap turnably carried by the cap body, wherein the closure cap has a non-round or slit-shaped orifice, and where there is provided a stopper blade in the closure cap and receivable in the orifice so as to close it off. Means are provided for turnably mounting the stopper blade on the spout portion of the cap body to enable it to turn simultaneously with turning of the closure cap, and in addition, there are cooperable means on the cap body and closure cap, for effecting relative axial movement between the stopper blade and the closure cap in response to turning of the closure cap on the cap body, thereby to enable the stopper blade to open or close the orifice.

In the preferred embodiment, the stopper blade is keyed to the closure cap and turns with it. Under such circumstances, no flexing or bending of the various components is required, as in the case of the patented ribbon-dispenser cap constructions noted above. Consequently there is no undue stress applied to the closure cap or stopper blade. Greatly improved operation results, particularly with respect to smoothness of operation, and there is achieved significantly increased reliability over extended time periods.

All internal stresses which develop within the disclosed construction are of a type which do not give rise to any significant deformation of the various parts; thus there are completely eliminated any potential problems with a particular component breaking, or taking a "set"; or possible loss of resilience of one of the components resulting in an operating failure. Also, the problem noted above in connection with contamination by plastic fragments is completely avoided.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 1:
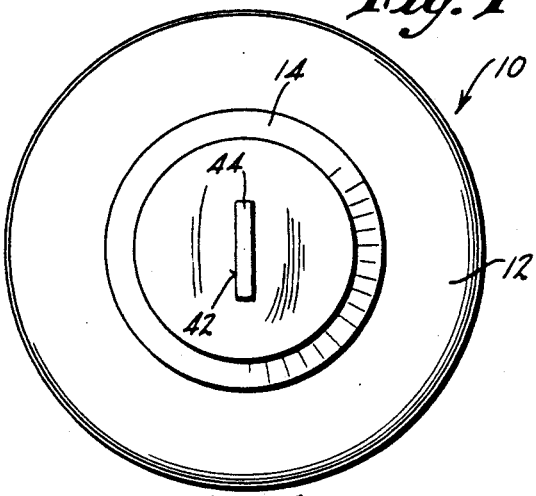
FIG. 1 is a top plan view of the improved dispensing cap construction of the present invention.
Figure 2:
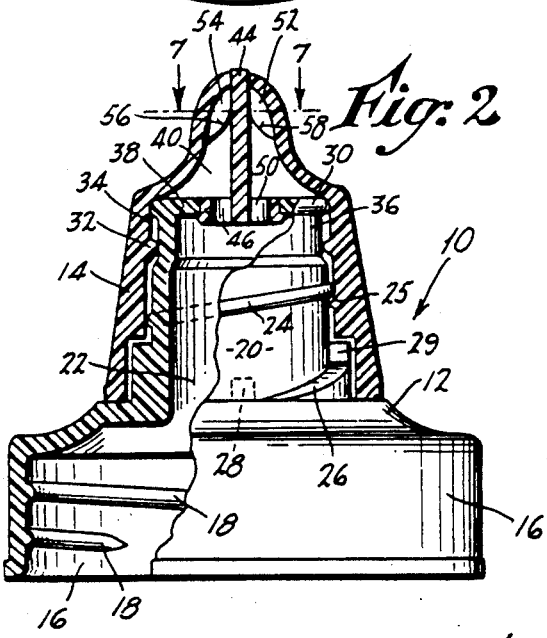
FIG. 2 is a view partly in axial section and partly in side elevation, of the improved dispensing cap construction of FIG. 1, shown in its closed, sealing position.
Figure 3:
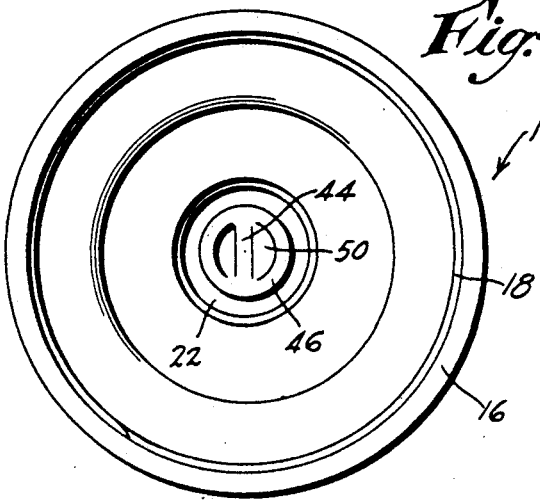
FIG. 3 is a bottom plan view of the cap construction of FIGS. 1 and 2.

Referring first to FIGS. 1-3 there is illustrated a dispensing cap construction generally designated by the numeral 10 and comprising a cap body 12 and a closure cap 14 turnably carried thereon. The cap body 12 has a depending skirt 16 containing internal threads 18 for engagement with cooperable threads on the neck of a container (not shown), in the usual manner, and has an upstanding discharge spout 20 which defines a chamber 22 that communicates with the interior of the container.

The outer surface of the discharge spout 20 has an external thread 24 engageable with a closure cap thread 25, and at the base of the spout there is a pair of cam tracks 26, integral with the remainder of the cap body 12, one track being shown in FIG. 2. Cooperable cam follower lugs 28 on the underside of the closure cap 14 engage the cam tracks 26 when the closure cap 14 is unscrewed, and ride up the tracks 26 causing axially outward shifting of the closure cap 14 with respect to the cap body 12.

On the outer surface of the discharge spout 20 is a sealing and retainer bead 30, which cooperates with an internal sealing and retainer bead 32 on the inner surface of the closure cap. As the closure cap 14 is moved axially, the bead 30 engages a cooperable cylindrical surface 34 on the underside of the closure cap 14, and the bead 32 similarly engages a cylindrical surface 36 on the discharge spout 20, to provide a seal.

The internal chamber 22 of the discharge spout 20 communicates with the interior of the container. The closure cap 14, with a transverse top wall 38 of the discharge spout 20, defines a second chamber 40, as will be further explained below.

Figure 4:
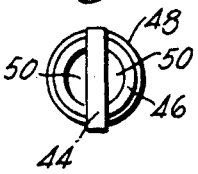
FIG. 4 is a top plan view of the stopper blade and hub of the cap construction of FIGS. 1-3.
Figure 5:
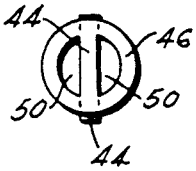
FIG. 5 is a bottom plan view of the stopper blade of FIG. 4.
Figure 6:
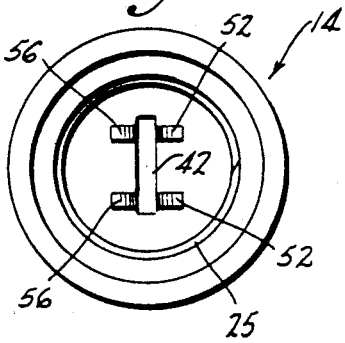
FIG. 6 is a bottom plan view of the closure cap portion of the cap construction of FIGS. 1-3.

In accordance with the present invention there is provided a novel and improved closure and discharge mechanism on the cap body 12 and closure cap 14, which functions to form the product being dispensed into an essentially flat, ribbon-like shape, thereby facilitating spreading the product over a relatively large area and with a greater uniformity than is possible with conventional cylindrical plug-type sealing dispenser caps. In accomplishing the objective of the invention, the closure cap 14 has a non-round or slit-shaped orifice 42 in its top wall, and there is movably mounted in the chamber 40 of the closure cap, a stopper blade 44, particularly shown in FIGS. 4 and 5. By the invention, the stopper blade 44 is keyed for simultaneous turning movement with the closure cap 14, and is turnably mounted on the transverse top wall 38 of the discharge spout 20. The stopper blade 44 can be in the form of an essentially flat slab, as shown. Integral with the slab is a mounting hub 46 having a retainer bead 48, which hub 46 is pressed into a central aperture in the top wall 38. The retainer bead 48 fits under the wall 38 and engages the undersurface thereof to thereby retain the blade 44 against upward axial movement with respect to the discharge spout 20 and closure cap 14, but enabling relative turning movement between the blade 44 and spout 20 to occur. The hub 46 is ring-shaped, and has one or more discharge passages 50 therethrough, providing communication between the chamber 22 formed by the discharge spout 20 and the chamber 40 formed by the closure cap 14 and the upper surface of the top wall 38 of the discharge spout 20. The stopper blade 44 is held against downward axial movement with respect to the discharge spout by virtue of the engagement of its lower edge with the upwardly facing surface of the top wall 38. The bead 48 and the lower edge thus constitute stop shoulders which engage opposite surfaces of the wall 38, and prevent axial movement of the blade on the spout portion 20.

Figure 7:
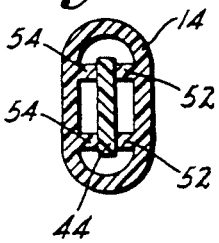
FIG. 7 is a horizontal section taken on the line 7—7 of FIG. 2, particularly showing the stopper blade, and showing keying ribs depending from the undersurface of the closure cap and slidably engaging the stopper blade.

In accomplishing the keying of the stopper blade 44 to the closure cap 14, there are provided on the undersurface of the closure cap 14, two pairs of depending keying ribs 52, 54, shown in FIGS. 2 and 7. Each rib has a curved lead-in edge 56, 58, FIG. 2, which facilitates assembly of the closure cap 14 over the stopper blade 44. The ribs 52, 54 are of a sufficient length measured axially of the closure cap 14, to ensure engagement with the stopper blade 44 for both the fully-on seated position, FIG. 2, and the raised, dispensing position (not shown) of the closure cap 14. This raised position is defined by the engagement of the lugs 28 with abutment shoulders 29, one of which is shown in FIG. 2, each shoulder being located at the upper end of the respective cam track 26. In such raised position, the closure cap is shifted axially of the cap body 12 by a distance equal to the pitch of either cam track 26.

In operation, the cap construction 10 as illustrated in FIG. 2 is in its storage or shipping condition, with the closure cap 14 fully seated on the cap body 12. The cam lugs 28 on the underside of the closure cap are disposed at the bases of the cam tracks 26, and the upper end of the stopper blade 44 fully occupies the slit-shaped orifice 42 of the closure cap 14.

For purposes of explanation, it is assumed that the container with which the cap construction is being used is a plastic squeeze bottle.

When the consumer wishes to dispense product, as he unscrews the closure cap 14 the cam lugs 28 ride up the respective cam tracks 26, causing axially outward shifting of the closure cap 14, but not the stopper blade 44. Instead, the latter is held against axial movement by the hub 46, and such blade 44 merely rotates in unison with the closure cap 14. Though the non-round or slit-shaped orifice 42 clears the stopper blade 44, the ribs 52, 54 maintain their engagement with the stopper blade 44, thus keying it to the closure cap 14. There now exist two spaces on opposite sides of the stopper blade 44 and between the opposite longitudinal walls of the slit-shaped orifice 42, through which product discharge can occur. In particular, with the container inverted, product flows from the chamber 22, through openings 50 in the hub 46, into chamber 40, past the ribs 52, 54, and out the orifice 42. The illustrated slit-shape of the orifice 42 imparts a ribbon configuration to the product if such product is of a creamy or relatively viscous consistency, as in the case of mustard. Such a ribbon can be applied readily to a hot dog, for example, by squeezing the container as the orifice 42 is drawn along the length of the hot dog.

As a consequence, there results a more even distribution of the mustard, with less tendency to form lumps and/or globs which might collect and fall off as the hot dog is being eaten, or otherwise held.

Following use, the consumer twists the closure cap 14 towards it seated position, the threads 24, 25 operating to shift the closure cap 14 in an axially downward direction, and the cam lugs 28 simultaneously merely riding back down the respective cam tracks. The blade 44 turns with the closure cap 14, being guided during such turning by the ribs 52, 54, which slide down the blade 44 as the closure cap 14 is seated.

By the present invention no flexing of the various parts is required. The stopper blade 44 remains intact as a planar structure, undergoing little or no deformation, since it is free to rotate with the closure cap 14.

As a result there are effectively eliminated potential problems with breakage of the various components or possible binding or jamming of the relatively moveable parts, as well as complications arising from one or more of the plastic parts taking a "set" and possibly interfering with or even defeating proper operation of the dispensing cap 10. The elimination of possible breakage is considered to be an important aspect of the invention, since the presence of plastic fragments could constitute a safety hazard if the cap construction were to be used for dispensing mustard or other foods, for example.

It is believed that the disclosed ribbon-type dispenser cap construction thus solves many of the problems that existed with prior dispenser caps of this type, and in a relatively simple and inexpensive manner.

Accordingly the device is seen to truly represent a distinct breakthrough in the field of ribbon-type cap constructions.

Figure 8:
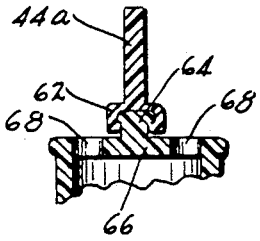
FIG. 8 is a fragmentary axial section through the stopper blade and discharge spout of a modification of the invention.

Another embodiment of the invention is illustrated in FIG. 8 which shows a modified blade **44*a* having at its bottom a socket formation 62 which loosely receives a bulbous protuberance 64 provided at the center of the top spout wall 66. The wall 66 has discharge passages 68 for the product. The socket formation 62 is round, as is the protuberance 64 to permit turning of the blade 44*a***. Operation is similar to that described above.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. A dispensing cap construction for containers, comprising in combination;

a) a cap body and means for attaching the cap body to a container neck, said cap body having a discharge spout portion, b) a closure cap turnably carried by the cap body and overlying said spout portion, c) said closure cap having a non-round orifice, d) a stopper blade located in said closure cap and receivable in said orifice to close off said orifice, and e) means for rotatably mounting said stopper blade on the spout portion of the cap body and for simultaneously retaining the stopper blade against axial movement with respect to the spout portion of the cap body, to enable the stopper blade to rotate with the closure cap while the stopper blade is held against axial movement with respect to the closure cap, as the closure cap is turned.

2. A cap construction as in claim 1, and further including:

a) a means on the undersurface of the closure cap for keying the stopper blade for simultaneous rotating movement with said closure cap.

3. A cap construction as in claim 2, wherein:

a) said keying means is engageable with the stopper blade for different axial positions of the closure cap with respect to the stopper blade.

4. A cap construction as in claim 2, wherein:

a) said keying means comprises a rib on the closure cap, to engage side portions of the stopper blade.

5. A dispensing cap construction for containers, comprising in combination:

a) a cap body and means for attaching the cap body to a container neck, and having a discharge spout portion through which the container contents can be discharged, b) a closure cap turnably carried by the cap body, c) said closure cap having a non-round orifice, d) a stopper blade located in said closure cap and receivable in said orifice to close off said orifice, e) means for rotatably mounting said stopper blade on the spout portion of the cap body to enable said stopper blade to rotate with turning movements of the closure cap, and f) cooperable means on said cap body and closure cap, for effecting relative axial movement of the closure cap with respect to both the cap body and the blade in response to turning of the closure cap on the cap body, thereby to enable said blade to close and open the orifice.

6. A cap construction as in claim 5, wherein:

a) the means for rotatably mounting the stopper blade comprises a wall of said spout portion, having an aperture, b) said blade having bearing means extending into said aperture of the spout portion.

7. A cap construction as in claim 6, wherein:

a) the apertured wall of the spout portion comprises an end wall thereof, b) said aperture being centrally disposed in said end wall.

8. A cap construction as in claim 7, wherein:

a) the bearing means of the blade comprises a hub having means for preventing axial movement of the blade.

9. A cap construction as in claim 6, wherein:

a) said blade has stop shoulders engaging opposite surfaces of the apertured wall of the spout portion, to limit axial movement of the blade.

10. A cap construction as in claim 5, wherein:

a) said closure cap has shoulder means engageable with the blade for maintaining alignment of the blade with the non-round orifice.

11. A cap construction as in claim 10, wherein:

a) said shoulder means comprises a plurality of ribs for engaging side edge portions of the blade.

12. A cap construction as in claim 5, wherein:

a) cooperable sealing means are provided between the closure cap and the spout portion of the cap body, said sealing means being effective for all different positions of the closure cap on the cap body.

13. A dispensing cap construction for containers, comprising in combination:

a) a cap body and means for attaching the cap body to a container neck, and having a discharge spout portion through which the container contents can be discharged, b) a closure cap turnably carried by the cap body, c) said closure cap having a non-round orifice, d) a stopper blade located in said closure cap and receivable in said orifice to close off said orifice, e) means for rotatably mounting said stopper blade on the spout portion of the cap body to enable said stopper blade to rotate with turning movements of the closure cap, f) cooperable means on said cap body and closure cap, for effecting relative axial movement of the blade with respect to the closure cap in response to turning of the closure cap on the cap body, thereby to enable said blade to close and open the orifice, and g) cooperable means on the spout portion of the cap body and on the stopper blade for preventing relative axial movement therebetween.

14. A dispensing cap construction for containers, comprising in combination:

a) a cap body and means for attaching the cap body to a container neck, and having a discharge spout portion through which the container contents can be discharged, b) a closure cap turnably carried by the cap body, c) said closure cap having a non-round orifice, d) a stopper blade located in said closure cap and receivable in said orifice to close off said orifice, e) means for rotatably mounting said stopper blade on the spout portion of the cap body to enable said stopper blade to rotate with turning movements of the closure cap, f) cooperable means on said cap body and closure cap, for effecting relative axial movement of the blade with respect to the closure cap in response to turning of the closure cap on the cap body, thereby to enable said blade to close and open the orifice, g) the means for rotatably mounting the stopper blade comprising an openbottom socket formation on the blade, and h) said spout portion having a wall and an upstanding protuberance on said wall, which is received in said socket formation.

15. A cap construction as in claim 14, wherein:

a) said wall of the spout portion comprises the top wall thereof.

16. A cap construction as in claim 14, wherein:

a) said socket is turnable on, and held captive by said protuberance, thereby to limit any axial movement of the stopper blade.

17. A cap construction as in claim 14, wherein:

a) said closure cap has shoulder means engageable with the blade for maintaining alignment of the blade with the non-round orifice.

* * * * *